US011492684B2

(12) United States Patent
Iwasaki

(10) Patent No.: US 11,492,684 B2
(45) Date of Patent: Nov. 8, 2022

(54) R-T-B BASED PERMANENT MAGNET

(71) Applicant: TDK CORPORATION, Tokyo (JP)

(72) Inventor: Makoto Iwasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 756 days.

(21) Appl. No.: 16/295,420

(22) Filed: Mar. 7, 2019

(65) Prior Publication Data

US 2019/0276917 A1 Sep. 12, 2019

(30) Foreign Application Priority Data

Mar. 12, 2018 (JP) ..... JP2018-043797

(51) Int. Cl.

| | |
|---|---|
| ***C22C 30/00*** | (2006.01) |
| ***H01F 1/057*** | (2006.01) |
| ***H01F 41/02*** | (2006.01) |
| ***B22F 3/24*** | (2006.01) |
| ***B22F 9/04*** | (2006.01) |
| ***B22F 3/16*** | (2006.01) |

(52) U.S. Cl.

CPC ..... *C22C 30/00* (2013.01); *B22F 3/16* (2013.01); *B22F 3/24* (2013.01); *B22F 9/04* (2013.01); *H01F 1/0577* (2013.01); *H01F 41/0266* (2013.01); *H01F 41/0293* (2013.01); *B22F 2003/248* (2013.01); *B22F 2301/45* (2013.01)

(58) Field of Classification Search

None

See application file for complete search history.

(56) References Cited

U.S. PATENT DOCUMENTS

| | | | | |
|---|---|---|---|---|
| 2010/0129538 | A1* | 5/2010 | Kunieda | H01F 41/0293 427/127 |
| 2015/0155083 | A1 | 6/2015 | Miwa et al. | |
| 2015/0235750 | A1 | 8/2015 | Miwa et al. | |
| 2016/0086701 | A1* | 3/2016 | Miwa | H02K 1/02 310/156.01 |

FOREIGN PATENT DOCUMENTS

| | | | |
|---|---|---|---|
| WO | 2013/122255 | A1 | 8/2013 |
| WO | 2013/122256 | A1 | 8/2013 |

* cited by examiner

*Primary Examiner* — Anthony J Zimmer
*Assistant Examiner* — Jacob J Gusewelle
(74) *Attorney, Agent, or Firm* — Oliff PLC

(57) ABSTRACT

An R-T-B based permanent magnet, in which R is a rare earth element, T is Fe or a combination of Fe and Co, and B is boron, includes main phase grains made of an $R_2T_{14}B$ crystal phase and grain boundaries formed between the main phase grains. The grain boundaries include an R—O—C—N concentrated part having higher concentrations of R, O, C, and N than that of the main phase grains. The R—O—C—N concentrated part includes a heavy rare earth element. The R—O—C—N concentrated part has a core part and a shell part covering at least part of the core part. A concentration of the heavy rare earth element in the shell part is higher than a concentration of the heavy element in the core part. A covering ratio of the shell part with respect to the core part of the R—O—C—N concentrated part is 45% or more in average.

16 Claims, 6 Drawing Sheets

R-T-B BASED PERMANENT MAGNET

TECHNICAL FIELD

The present invention relates to an R-T-B based permanent magnet.

BACKGROUND

An R-T-B based sintered magnet has excellent magnetic properties, but a corrosion resistance tends to be low because a rare earth element which is easily oxidized is included as a main component.

In order to improve the corrosion resistance of the R-T-B based sintered magnet, for example, Patent Document 1 proposes an R-T-B based sintered magnet having an R—O—C concentrated part in a grain boundary wherein concentrations of R, O, and C are higher than in $R_2T_{14}B$ crystal grains, and a ratio of O atom is regulated with respect to R atom in the R—O—C concentrated part within an appropriate range.

Also, Patent Document 2 proposes an R-T-B sintered magnet having an R—O—C concentrated part in a grain boundary wherein concentrations of R, O, and C are higher than in $R_2T_{14}B$ crystal grains, and an area ratio of the R—O—C concentrated part occupying a cross section of the R-T-B based sintered magnet is regulated within an appropriate range.

[Patent Document 1] WO 2013/122255

[Patent Document 2] WO 2013/122256

SUMMARY

The present inventors have found that in case of including a specific type of grain boundary phase, an R-T-B based permanent magnet having excellent residual magnetic flux density Br, coercive force HcJ, and corrosion resistance can be obtained.

The object of the present invention is to provide the R-T-B based permanent magnet having improved magnetic properties (HcJ and Br) and corrosion resistance compared to a conventional R-T-B based sintered magnet.

The R-T-B based permanent magnet according to the present invention includes main phase grains consisting of an $R_2T_{14}B$ crystal phase and grain boundaries formed between the main phase grains, wherein R is a rare earth element, T is Fe or a combination of Fe and Co, and B is boron, wherein the grain boundaries include an R—O—C—N concentrated part having higher concentrations of R, O, C, and N than in the main phase grains, the R—O—C—N concentrated part includes a heavy rare earth element, the R—O—C—N concentrated part comprises a core part and a shell part at least partially covering the core part, a concentration of the heavy rare earth element in the shell part is higher than a concentration of the heavy rare earth element in the core part, a covering ratio of the shell part with respect to the core part in the R—O—C—N concentrated part is 45% or more in average.

The R-T-B based permanent magnet of the present invention can have enhanced HcJ and Br, and improved corrosion resistance by having the above constitution.

An area ratio of the R—O—C—N concentrated part may be 16% or more and 71% or less in total with respect to the grain boundaries.

A ratio (O/R) of O atom with respect to R atom in the R—O—C—N concentrated part may be 0.44 or more and 0.75 or less in average.

A ratio (N/R) of N atom with respect to R atom in the R—O—C—N concentrated part may be 0.25 or more and 0.46 or less in average.

A oxygen content in the R-T-B based permanent magnet may be 920 ppm or more and 1990 ppm or less.

A content of carbon in the R-T-B based permanent magnet may be 890 ppm or more and 1150 ppm or less.

DETAILED EMBODIMENTS

Hereinafter, an embodiment of the present invention is explained using the figures. Note that, the present invention is not to be limited thereto.

<R-T-B Based Permanent Magnet>

Figure 1:
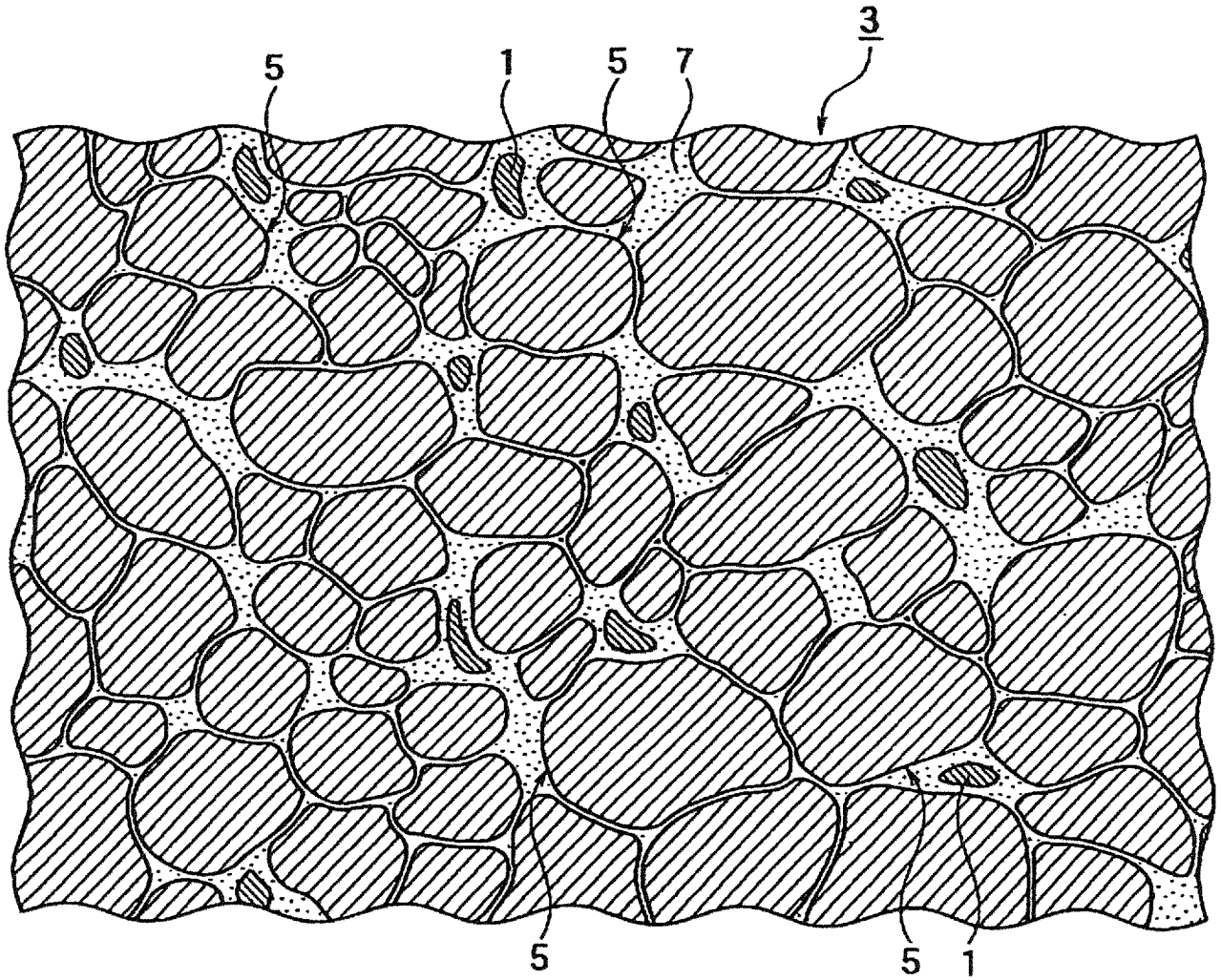
FIG. 1 is a schematic image of an R-T-B based permanent magnet according to an embodiment of the present invention.

An R-T-B based permanent magnet 3 according to the present embodiment is described. As shown in FIG. 1, the R-T-B based permanent magnet 3 according to the present embodiment has main phase grains 5 consisting of an $R_2T_{14}B$ phase and grain boundaries 7 formed between the main phase grains 5, and has an R—O—C—N concentrated part 1 in the grain boundaries 7 wherein the concentrations of R (rare earth element), O (oxygen), C (carbon), and N (nitrogen) are higher than in the main phase grains 5.

The $R_2T_{14}B$ phase has a crystal structure made of $R_2T_{14}B$ type tetragonal. Also, the main phase grains 5 may include other phases than the $R_2T_{14}B$ phase, and other elements than R, T, and B. An average particle size of the main phase grains 5 is usually 1 μm to 30 μm or so.

The R—O—C—N concentrated part 1 exist in the grain boundaries 7 formed between two or more main phase grains 5 adjacent to each other, and each of the concentrations of R, O, C, and N is higher in this area than in the main phase grains 5. The R—O—C—N concentrated part 1 may include other components besides R, O, C, and N. The R—O—C—N concentrated part 1 preferably exist in the grain boundaries formed between three or more of the main phase grains (a triple point grain boundary). Also, the R—O—C—N concentrated part 1 may exist in the grain boundary formed between the adjacent two main phase grains (a grain boundary between two grains), and the R—O—C—N concentrated part 1 preferably exist in 1% or less of a total area of the grain boundary between two grains.

Also, in the grain boundaries 7 of the R-T-B based permanent magnet according to the present embodiment, other phases beside the R—O—C—N concentrated part 1 may exist. For example, an R-rich phase may exist in which R concentration is higher than in the main phase grains 5 and the concentrations of one or more of O, C, and N are same or less than that in the main phase grains 5. Also, a B-rich phase may be included in which B concentration is higher than in the main phase grains.

R represents at least one selected from a rare earth element. The rare earth element includes Sc, Y, and lanthanoid, which belong to a third group of a long period type periodic table. For example, the lanthanoid include La, Ce, Pr, Nd, Sm, Eu, Gd, Tb, Dy, Ho, Er, Tm, Yb, Lu, and the like. A rare earth element is classified into a light rare earth element (hereinafter, this may be referred as RL) and a heavy rare earth element (hereinafter, this may be referred as RH). A heavy rare earth element includes Y, Gb, Tb, Dy, Ho, Er, Tm, Yb, and Lu. A light rare earth element is a rare earth element other than the heavy rare earth element. In the present embodiment, RH is included as R. Further, from the point of a production cost and the magnetic properties, RL is also included together with RH as R. As RL, Nd and/or Pr are preferably included. As RH, Dy and/or Tb are preferably included.

T is Fe or a combination of Fe and Co. T may be Fe alone, and part of Fe may be substituted by Co. When part of Fe is substituted by Co, temperature properties and the corrosion resistance can be improved without decreasing the magnetic properties.

B is boron.

The R-T-B based permanent magnet according to the present embodiment may further include M element. As M element, Ti, V, Cr, Mn, Ni, Cu, Zr, Nb, Mo, Hf, Ta, W, Al, Ga, Si, Bi, and Sn may be mentioned.

R content in the R-T-B based permanent magnet according to the present embodiment can be 25.0 mass % or more and 35.0 mass % or less, and preferably 28.0 mass % or more and 33.0 mass % or less. The lower the R content is, the more effectively the $R_2T_{14}B$ phase is suppressed from forming. Therefore, α-Fe and the like having a soft magnetism tends to be easily precipitated, and the magnetic properties tend to easily decrease. When R content is too much, a volume ratio of the grain boundaries increase, and the volume ratio of the main phases relatively decrease, thus the magnetic properties tend to decrease.

B content in the R-T-B based permanent magnet according to the present embodiment can be 0.7 mass % or more and 1.5 mass % or less, preferably 0.8 mass % or more and 1.2 mass % or less, and more preferably 0.8 mass % or more and 1.0 mass % or less. As B content decreases, HcJ tends to easily decrease. Also, as B content increases, Br tends to easily decrease. Also, B site of the main phase can be substituted by C in a certain amount, and when B content in the R-T-B based permanent magnet is within the above mentioned preferable range, the variation of content of the R—O—C—N concentrated part 1 is less.

Fe content in the R-T-B based permanent magnet according to the present embodiment is substantially balance of the constituting element of the R-T-B based permanent magnet. Also, Co content is preferably 20 mass % or less with respect to a sum of Co and Fe contents. This is because if Co content is too large, the magnetic properties may decrease, and also the cost of the R-T-B based permanent magnet may increase. Also, Co content is preferably 4.0 mass % or less, more preferably 0.1 mass % or more and 3.0 mass % or less, and further preferably 0.3 mass % or more and 2.5 mass % or less with respect to the entire R-T-B based permanent magnet.

In case of including Al and/or Cu as M, a total content is preferably within the range of 0.20 mass % or more and 0.60 mass % or less. By including Al and/or Cu within this range, the obtained magnet can have increased HcJ and corrosion resistance and enhanced temperature properties. Al content is preferably 0.03 mass % or more and 0.4 mass % or less, and more preferably 0.05 mass % or more and 0.25 mass % or less. Also, Cu content is preferably 0.30 mass % or less (but does not include zero), and more preferably 0.25 mass % or less (but does not include zero), and further preferably 0.03 mass % or more and 0.2 mass % or less.

In case of including Zr as M, Zr content is preferably within the range of 0.07 mass % or more and 0.70 mass % or less. By including Zr within this range, the area ratio of the R—O—C—N concentrated part with respect to the grain boundaries can be stabilized because a compound combining Zr and C (for example ZrC) is precipitated in a certain amount.

In the R-T-B based permanent magnet according to the present embodiment, a certain amount of oxygen (O) is included. The certain amount changes depending on other parameters and the like, and it is determined accordingly. For example, it may be 500 ppm or more and 2000 ppm or less. O content is preferably high from the point of improving the corrosion resistance, on the other hand, preferably it is low from the point of improving the magnetic properties.

Carbon (C) content in the R-T-B based permanent magnet according to the present embodiment changes depending on other parameters and the like, and it is determined accordingly. For example, it may be 400 ppm or more and 3000 ppm or less. Preferably, it is 400 ppm or more and 2500 ppm or less, more preferably 400 ppm or more and 2000 ppm or less. When C content is too large, the magnetic properties tend to decrease, and when C content is too small, the R—O—C—N concentrated part tends to become difficult to form.

Also, Nitrogen (N) content in the R-T-B based permanent magnet according to the present embodiment changes depending on other parameters and the like, and it is determined accordingly. For example, it may be 100 ppm or more and 1200 ppm or less, preferably 200 ppm or more and 1000 ppm or less, and more preferably 300 ppm or more and 800 ppm or less. When N content is too large, the magnetic properties tend to decrease, and when N content is too small, the R—O—C—N concentrated part tends to become difficult to form.

O, C, and N contents in the R-T-B based permanent magnet can be measured by a conventionally known measuring method. O content may be measured for example by an inert gas fusion—non-dispersive infrared absorption method. C content may be measured for example by an oxygen airflow—infrared absorption method. N content may be measured for example by an inert gas fusion—thermal conductivity method.

Figure 2:
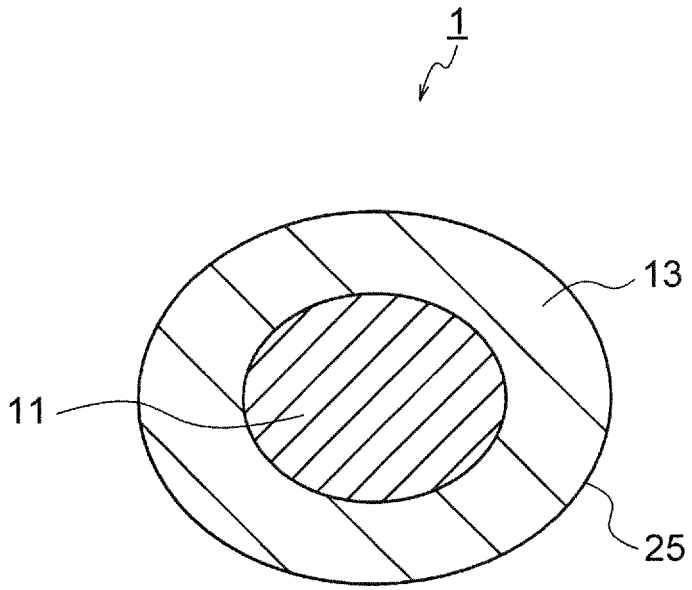
FIG. 2 is a schematic image of an R—O—C—N concentrated part having a core-shell structure.

As shown in FIG. 2, the R-T-B based permanent magnet 3 according to the present embodiment includes the R—O—C—N concentrated part 1, and at least part of the R—O—C—N concentrated part 1 has the core-shell structure having a core part 11 and a shell part 13. The core-shell structure refers to the structure in which RH concentration is higher in a surrounding part (shell part) than in a center part (core part).

When the main phase grains 5 have the core-shell structure in which the shell part is formed by RH concentrating near the grain boundaries 7 of the main phase grains 5, the magnetic properties of the R-T-B based permanent magnet 3 are improved. However, when the main phase grains 5 have the core-shell structure, and the R—O—C—N concentrated part 1 does not have the core-shell structure and has uniform RH concentration, RH supplied to the shell part of the main phase grains 5 is not enough, and the core-shell structure of the main phase grains 5 is not sufficiently formed, thus significant improvement of the magnetic properties of the R-T-B based permanent magnet 3 may not be expected. This phenomenon is prominent in case of the R-T-B based permanent magnet of which RH is supplied by a diffusion step. In case the R—O—C—N concentrated part 1 includes RH, compared to the case of only including RL (light rare earth element), excellent corrosion resistance is exhibited because a redox potential is high. In order to improve the corrosion resistance, the RH concentration may not be high in entire R—O—C—N concentrated part 1, and the RH concentration may only be high in the shell part 13 of the R—O—C—N concentrated part 1. By the R—O—C—N concentrated part 1 having the core-shell structure and by decreasing the RH concentration of the core part 11, the RH concentration near the main phase of the grain boundaries 7 can be increased, and thereby the core-shell structure of the main phase grains 5 tends to be easily formed. Thus, the R-T-B based permanent magnet 3 having excellent corrosion resistance and magnetic properties can be obtained.

The above effects are even more enhanced when the R—O—C—N concentrated part 1 exist in the triple point grain boundary.

The R—O—C—N concentrated part 1 included in the R-T-B based permanent magnet 3 according to the present embodiment may include those which does not have the core-shell structure.

The R—O—C—N concentrated part 1 of the present embodiment has the shell part 13 in which the RH concentration is higher than that in the core part 11, and a covering ratio of the shell part 13 with respect to the core part 11 is 45% or more. As the R—O—C—N concentrated part 1 has the core-shell structure, and the covering ratio is 45% or more, the corrosion resistance is improved, and further the magnetic properties (HcJ and Br) are improved.

The covering ratio of the R—O—C—N concentrated part 1 is a ratio of a length of the shell part 13 with respect to an outer circumference part 25 of the R—O—C—N concentrated part 1. Note that, in the R—O—C—N concentrated part 1 shown in FIG. 2, the shell part 13 completely covers the core part 11. Thus, the outer circumference part 25 is entirely shell part 13, hence the covering ratio is 100%.

Figure 5:
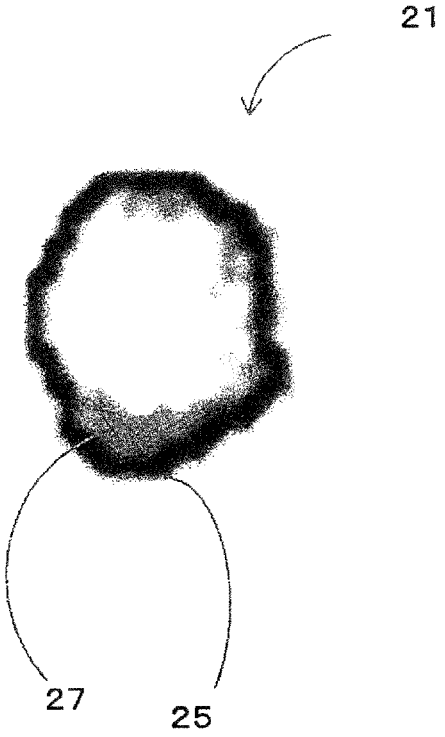
FIG. 5 is an enlarged image showing a position relation between the R—O—C—N concentrated part and a high RH part included in FIG. 3.

Also, FIG. 5 is an R—O—C—N concentrated part 21 having the core-shell structure included in Example 1-5 which is discussed in below. A high RH part 27 having a high RH content is formed as the shell part of the R—O—C—N concentrated part 21 having the core-shell structure, and covers part of the core part. In this case, the length of the high RH part 27 with respect to the length of the entire outer circumference part 25 is the covering ratio.

Figure 6:
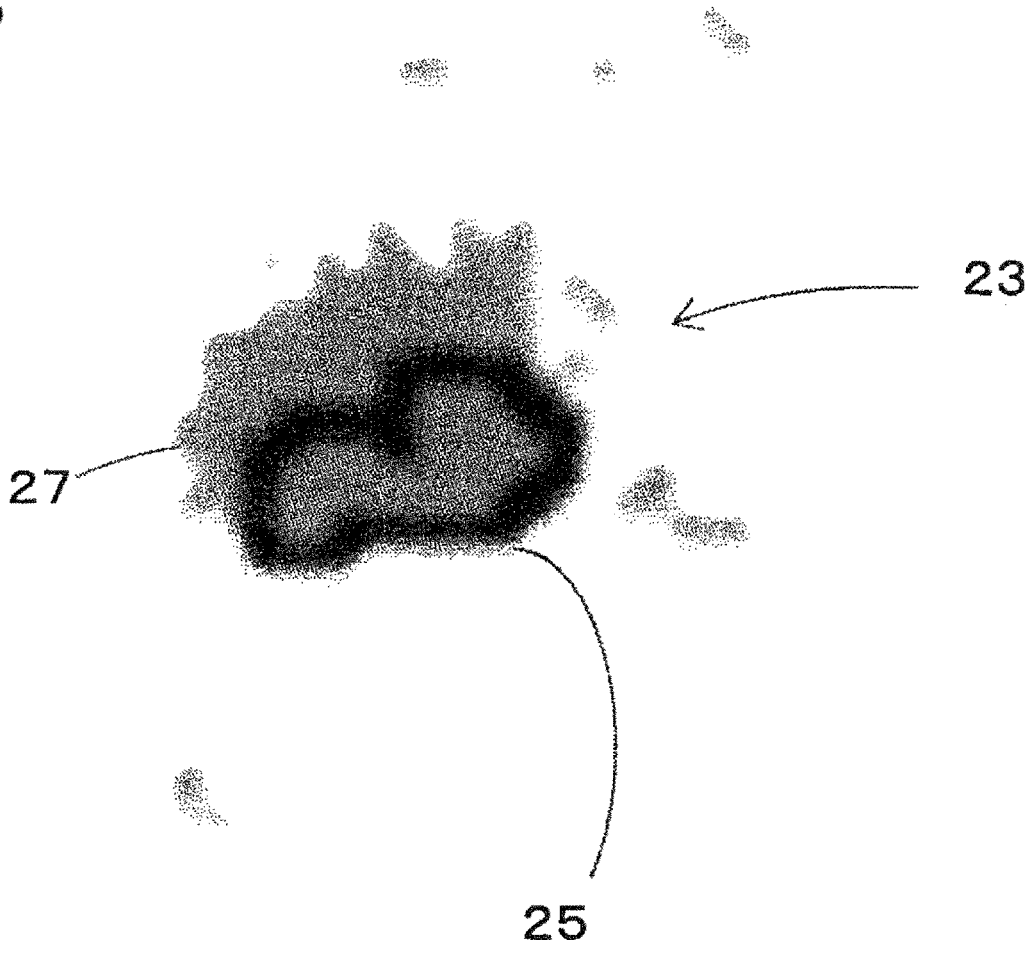
FIG. 6 is an enlarged image showing a position relation between the R—O—C—N concentrated part and a high RH part included in FIG. 4.

FIG. 6 is an R—O—C—N concentrated part 23 not having the core-shell structure which is included in Comparative Example 1-5 discussed in below. The high RH part 27 having a high RH content entirely occupies the R—O—C—N concentrated part 23, and the core part and the shell part are not distinguished.

Note that, in case the area other than the high RH part in the R—O—C—N concentrated part 1 is less than 10%, it is considered that the R—O—C—N concentrated part 1 does not have the core-shell structure. In this case, the covering ratio is 0%.

The covering ratio of the R-T-B based permanent magnet 3 according to the present embodiment is calculated as follows. In a cross section of the R-T-B based permanent magnet 3, an observation area of 40 μm×40 μm or larger is determined, and the R—O—C—N concentrated part 1 in the observation area is identified. A total length of the outer circumference part of all of the R—O—C—N concentrated parts 1 and a total of the length of the shell part 13 are calculated. The covering ratio is the ratio of the total length of the shell part 13 with respect to the total length of the outer circumference part of the R—O—C—N concentrated part 1, and it is calculated as (total length of the shell part 13)/(total length of the outer circumference part 25).

The area ratio of the R—O—C—N concentrated part 1 occupying the grain boundaries 7 may be any ratio, and preferably it is 16% or more and 71% or less.

Hereinafter, an example of a method of calculating the area ratio of the R—O—C—N concentrated part 1 occupying the grain boundaries 7 is described. Note that, in below, the area of the R—O—C—N concentrated part 1 may be referred as a, and the area of the grain boundaries 7 may be referred as β.

(1) A backscattered electron image is binarized at a predetermined level to identify a main phase part and a grain boundary part, and then the area (β) of the grain boundaries 7 is calculated. Any method can be used as a method for identifying the main phase part and the grain boundary part by binarizing at a predetermined level, and a generally used method may be used.

(2) From a mapping data of characteristic X-ray intensity of Nd, O, C, and N obtained from EPMA, an average of the characteristic X-ray intensity and a standard deviation of the characteristic X-ray intensity of each element of Nd, O, C, and N in the main phase part identified by the above (1) are calculated. Then, (the average value of the characteristic X-ray intensity+three times of the standard deviation of the characteristic X-ray intensity) is calculated for each element in the main phase part.

(3) From the mapping data of the characteristic X-ray intensity of Nd, O, C, and N obtained by EPMA, for each element, an area in the observation field having the characteristic X-ray intensity value equal or larger than (an average value+three times of the standard deviation of the characteristic X-ray intensity) in the main phase part obtained by the above (2) is identified. For each element, the area having the characteristic X-ray intensity value of equal or larger than (an average value+three times of the standard deviation of the characteristic X-ray intensity) in the main phase part is defined as the area where the concentration of the element is higher than in the main phase part.

(4) When the area identified as the grain boundary part by the above (1) and the area having higher concentrations of each element of Nd, O, C, and N than in the main phase part identified by the above (3) completely overlap, this area is identified as the R—O—C—N concentrated part 1 of the grain boundaries 7, and the area of this part is defined as the area (a) of the R—O—C—N concentrated part 1.

(5) The area ratio (α/β) of the R—O—C—N concentrated part 1 occupying the grain boundaries 7 can be calculated by dividing the area (α) of the R—O—C—N concentrated part 1 calculated in the above (4) by the area (β) of the grain boundaries 7 calculated in the above (1).

The R-T-B based permanent magnet 3 according to the present embodiment may supply a heavy rare earth element RH by diffusing from a surface towards inside of the magnet.

Since hydrogen produced by a corrosion reaction of R in the R-T-B based permanent magnet 3 with water (such as water vapor in used environment) is stored into an R-rich phase existing in the grain boundaries of the R-T-B based permanent magnet 3, corrosion of the R-T-B based permanent magnet 3 progresses. Corrosion of the R-T-B based permanent magnet 3 progresses in an accelerated pace towards inside of the R-T-B based permanent magnet 3.

That is, corrosion of the R-T-B based permanent magnet 3 is thought to progress in a process discussed in below. Since the R-rich phase existing in the grain boundaries is easily oxidized, R of the R-rich phase existing in the grain boundaries is first oxidized by water (such as water vapor and the like in used environment), and R is corroded, then forms hydroxides. During this process, hydrogen is produced.

$$2R+6H_2O \rightarrow 2R(OH)_3+3H_2 \quad (I)$$

Next, this produced hydrogen is stored in the R-rich phase which is not corroded.

$$2R+xH_2 \rightarrow 2RH_x \quad (II)$$

Thus, as more hydrogen gets stored in the R-rich phase, the R-rich phase tends to be corroded easily, and due to the corrosion reaction between water and the R-rich phase stored with hydrogen, hydrogen is produced more than the amount of hydrogen stored in the R-rich phase.

$$2RH_x+6H_2O \rightarrow 2R(OH)_3+(3+x)H_2 \quad (III)$$

That is, corrosion of the R-T-B based permanent magnet 3 progresses towards inside of the R-T-B based permanent magnet 3 due to the chain reactions of the above (I) to (III). Then, the R-rich phase changes to hydroxides of R and into hydrides of R. Due to a volume expansion associated with the changes of the R-rich phase, stress is accumulated in the R-T-B based permanent magnet which causes the crystal grains (main phase grains 5) to fall off from the R-T-B based permanent magnet 3. Then, due to this falling of the main phase grains 5, a newly formed surface of the R-T-B based permanent magnet 3 appears, and corrosion of the R-T-B based permanent magnet 3 further progresses towards inside of the R-T-B based permanent magnet 3.

In the R-T-B based permanent magnet 3 according to the present embodiment, the ratio (O/R) of O atom with respect to R atom in the R—O—C—N concentrated part 1 is 0.4 or more and 0.8 or less in average, and may be 0.44 or more and 0.75 or less in average. Preferably, it is 0.44 or more and 0.54 or less. In this case, (O/R) is smaller than a stoichiometric ratio composition of oxides of R ($R_2O_3$, $RO_2$, RO, and the like). Since the R—O—C—N concentrated part 1 having (O/R) within a predetermined range exist in the grain boundaries 7, water (such as water vapor and the like in used environment) can be suppressed from entering inside of the R-T-B based permanent magnet 3. Thus, hydrogen produced by the reaction between water and R in the R-T-B based permanent magnet 3 can be effectively suppressed from being stored in the entire grain boundaries. Further, the corrosion of the R-T-B based permanent magnet 3 can be suppressed from progressing towards inside of the magnet, and also the R-T-B based permanent magnet 3 according to the present embodiment can have good magnetic properties. In case (O/R) is too small, hydrogen produced by the corrosion reaction between water (such as water vapor and the like in used environment) and R in the R-T-B based permanent magnet 3 cannot be sufficiently suppressed from being stored in the grain boundaries 7, thus the corrosion resistance of the R-T-B based permanent magnet 3 tends to decrease. Also, in case (O/R) is too large, the consistency with the main phase grain 5 decreases, and HcJ tends to decrease.

Also, in the R-T-B based permanent magnet 3 according to the present embodiment, the ratio (N/R) of N atom with respect to R atom in the R—O—C—N concentrated part 1 may be larger than zero and 1 or less in average, and preferably 0.25 or more and 0.45 or less in average. That is, (N/R) is preferably smaller than a stoichiometric ratio composition of nitrides of R (RN and the like). As the R—O—C—N concentrated part 1 having (N/R) within a predetermined range exist in the grain boundaries 7, hydrogen produced by a corrosion reaction of R in the R-T-B based permanent magnet 3 with water is effectively suppressed from being stored to the R-rich phase existing in the grain boundaries. Further, corrosion of the R-T-B based permanent magnet 3 can be suppressed from progressing towards inside of the R-T-B based permanent magnet 3, and also the R-T-B based permanent magnet 3 according to the present embodiment can have good magnetic properties.

Also, the R—O—C—N concentrated part 1 preferably has a cubic type crystal structure. By having the cubic type crystal structure, hydrogen is suppressed from further stored in the grain boundaries, and the corrosion resistance of the R-T-B based permanent magnet 3 according to the present embodiment can be further enhanced.

As R included in the R—O—C—N concentrated part 1, RL and RH both are preferably included. The ratio of RL:RH in the R—O—C—N concentrated part 1 may be 1:10 to 10:90 in terms of mass ratio. By having RH in the R—O—C—N concentrated part 1, the R—O—C—N concentrated part 1 is less likely oxidized, and an excellent corrosion resistance can be obtained and also the magnetic properties can be further improved.

In the method of producing the R-T-B based permanent magnet 3 according to the present embodiment, a raw material as oxygen source and a raw material as carbon source included in the R—O—C—N concentrated part 1 are added in predetermined amount to a raw material alloy for R-T-B based permanent magnet. Then, production conditions such as oxygen concentration, nitrogen concentration, and the like in the atmosphere of the production process are regulated. Further, a diffusion of a heavy rare earth element is done under specific condition.

As the oxygen source of the R—O—C—N concentrated part 1, powder including oxides of M1 can be used. M1 is an element having higher standard free energy of formation for producing oxides than a rare earth element R. As the carbon source of the R—O—C—N concentrated part 1, powder including carbides of M2, powder including carbon, or organic compounds which generate carbon by thermal decomposition can be used. M2 is an element having higher standard free energy of formation for producing carbides than a rare earth element R. As the powder including carbon, graphite, carbon black, and the like may be mentioned. Also, surface oxidized particles can be used as the oxygen source, and metal particles including carbides such as cast iron and the like can be used as the carbon source.

The R—O—C—N concentrated part 1 formed in the grain boundaries 7 of the R-T-B based permanent magnet 3 according to the present embodiment is thought to be generated as discussed in below. Regarding the oxygen source including oxides of M1 which is added, M1 has higher standard free energy of formation for producing oxides than a rare earth element R. Therefore, when producing a sintered body by adding the oxygen source and the carbon source to the raw material alloy for R-T-B based permanent magnet and then sintering, oxides of M1 are reduced by the R-rich phase of a liquid phase state which is generated during sintering. Then, a metal M1 and O are produced. Also, when carbides of M2 (the element having higher standard free energy of formation than a rare earth element R) are added as the carbon source, a metal M2 and C are produced similarly. These metals of M1 and M2 are taken mainly into the main phase grains 5 or the R-rich phase. On the other hand, it is thought that O and C are precipitated in the grain boundaries 7, particularly in the triple point grain boundary as the R—O—C—N concentrated part due to reaction with part of R-rich phase together with N added by regulating the nitrogen concentration during production process.

In the conventional R-T-B based permanent magnet, due to oxidation and the like of raw material powder when pressing in an atmosphere, O is included as inevitable impurities. However, a rare earth element R in the raw material powder is oxidized and O included at this time is consumed by the reaction which forms oxides of R, further oxides of R are not reduced during the sintering process, thus it is thought that oxides of R precipitate in the grain boundaries.

On the other hand, in the production steps of the R-T-B based permanent magnet 3 according to the present embodiment, the atmosphere is regulated to extremely low oxygen concentration (for example, about 100 ppm or less) during each step of pulverizing, pressing, and sintering of the raw material alloy. Thereby, oxides of R are suppressed from forming. Therefore, together with C added as the carbon source and N added by regulating the nitrogen concentration during production process, O generated by the reduction of oxides of M1 in the sintering step are thought to precipitate in the grain boundaries as the R—O—C—N concentrated part 1. That is, according to the method of the present embodiment, oxides of R are suppressed from forming in the grain boundaries 7, and also the R—O—C—N concentrated part 1 having a predetermined composition can be precipitated.

Also, other than R—O—C—N concentrated part 1, an R—C concentrated part having higher concentrations of R and C than in the $R_2T_{14}B$ crystal grains, an R—O concentrated part (including oxides of R) having higher concentrations of R and O than in the $R_2T_{14}B$ crystal grains, and the like can be included in the grain boundaries 7. Further, other than these, the R-rich phase having higher concentration of R than in the $R_2T_{14}B$ crystal grains and an $R(Fe,Ga)_{14}$ phase including Ga exists. The R-rich phase and the $R(Fe,Ga)_{14}$ phase preferably exist in order to improve HcJ. However, the R—C concentrated part and the R—O concentrated part are preferably contained less, and more preferably these do not exist. For example, the R—C concentrated part is preferably 30% or less of the area of the grain boundaries 7, and the R—O concentrated part is preferably 10% or less of the area of the grain boundaries 7. As the R—C concentrated part increases, the corrosion resistance of the R-T-B based permanent magnet 3 tends to decrease, and as the R—O concentrated part increases, Br of the R-T-B based permanent magnet 3 tends to decrease.

A method for observing and analyzing the structure of the R-T-B based permanent magnet 3 according to the present embodiment is not particularly limited. For example, an element distribution can be observed and analyzed by EPMA (Electron Probe Micro Analyzer). For example, the composition of the R-T-B based permanent magnet 3 is observed for an area of 50 μm×50 μm by EPMA, and an elemental mapping (256 points×256 points) by EPMA can be carried out. As a specific example, FIG. 3 shows a backscattered electron image and observation results of each element of Tb, C, Nd, Fe, O, and N by EPMA of Example 1-5; and FIG. 4 shows a backscattered electron image and the elemental mapping image of each element of Tb, C, Nd, Fe, O, and N by EPMA of Comparative example 1-5.

Figure 3:
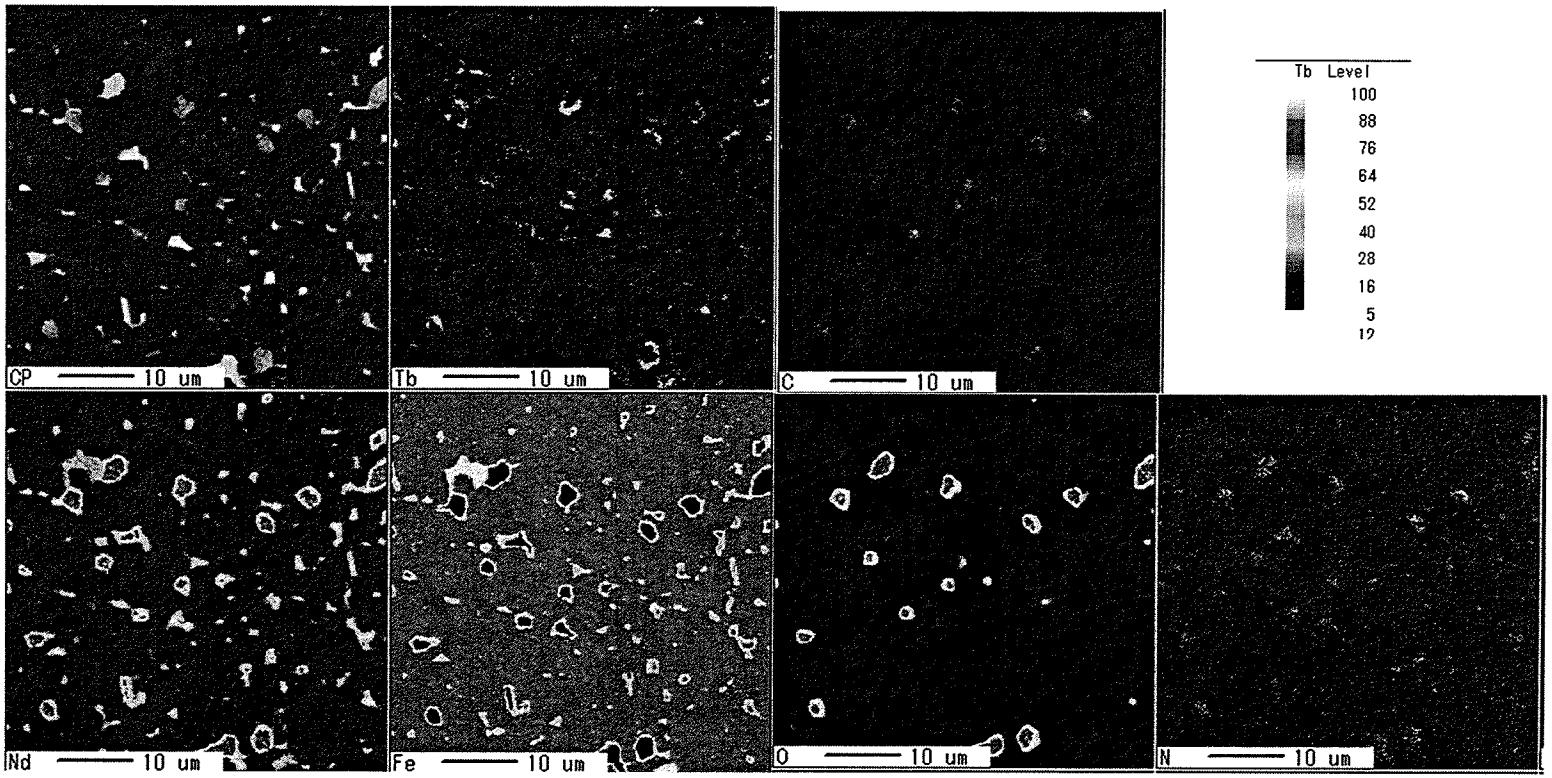
FIG. 3 is a backscattered electron image and observation results by EPMA of Example 1-5.
Figure 4:
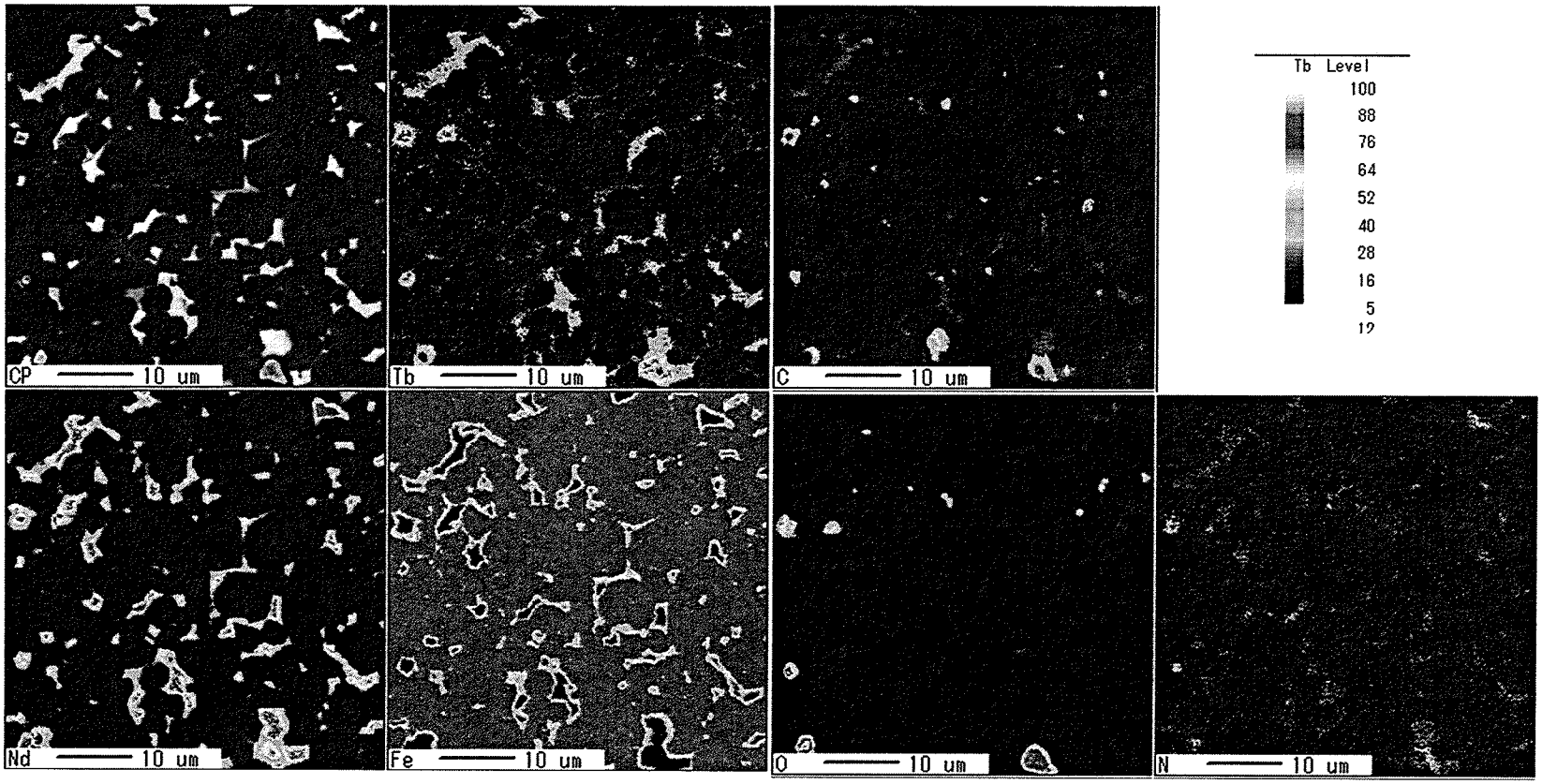
FIG. 4 is a backscattered electron image and observation results by EPMA of Comparative example 1-5.

In FIG. 3 and FIG. 4, there is an area in the grain boundaries in which each of the concentrations of R, O, C, and N are higher than in the main phases. This area is the R—O—C—N concentrated part. Also, the R—O—C—N concentrated part of FIG. 3 has different concentration of Tb between the core part and the shell part as shown in FIG. 5, and the shell part has a high Tb concentration which is a high Tb part. On the contrary to this, most part of the R—O—C—N concentrated part of FIG. 4 has the high Tb part across the entire R—O—C—N concentrated part as shown in FIG. 6.

Also, the R-T-B based permanent magnet according to the present embodiment can be used by processing into any shape. For example, it can be a columnar shape such as a rectangular parallelepiped shape, a hexahedron shape, a tabular shape, a square pole shape, and the like; a cylinder shape of which a cross section shape of the R-T-B based permanent magnet is C-shaped, and the like. As the square pole, for example, a bottom surface of the square pole may be rectangular or a square.

Also, the R-T-B based permanent magnet according to the present embodiment includes both a magnet product which has been magnetized by processing the magnet and a magnet product which has not magnetized.

<Method of Producing R-T-B Based Permanent Magnet>

An example of method of producing the R-T-B based permanent magnet according to the present embodiment having the above mentioned constitution is described. The method of producing the R-T-B based permanent magnet according to the present embodiment includes following steps:

(a) an alloy preparation step preparing a main phase alloy and a grain boundary alloy;

(b) a pulverization step pulverizing the main phase alloy and the grain boundary alloy;

(c) a mixing step mixing main phase alloy powder and grain boundary alloy powder;

(d) a pressing step wherein mixed powder is pressed;

(e) sintering step wherein a green compact is sintered to obtain the R-T-B based permanent magnet;

(f) a machining step wherein the R-T-B based permanent magnet is processed;

(g) a diffusing step wherein a heavy rare earth element is diffused into the grain boundaries of the R-T-B based permanent magnet.

(h) an aging treatment step wherein the R-T-B based permanent magnet is carried out with an aging treatment;

(i) a cooling step cooling the R-T-B based permanent magnet; and (j) a surface treatment step wherein the R-T-B based permanent magnet is surface treated.

[Alloy Preparation Step]

An alloy having a composition constituting the main phases (main phase alloy) and an alloy having a composition constituting the grain boundaries (grain boundary alloy) of the R-T-B based permanent magnet according to the present embodiment are prepared. A raw material metal corresponding to the composition of the R-T-B based permanent magnet according to the present embodiment is melted in vacuum or in inert gas atmosphere such as Ar gas and the like, then the melted raw material metals are casted to produce the main phase alloy and the grain boundary alloy having the desired compositions. Note that, in the present embodiment, a two-alloy method in which the two alloys that is the main phase alloy and the grain boundary phase alloy are mixed to produce the raw material powder is described, however a one-alloy method in which a single alloy, that is the main phase alloy and the grain boundary alloy are not separated, may be used as well.

As the raw material metal, for example, a rare earth metal or alloy of rare earth metal, pure iron, ferro-boron, compounds and alloys of these, and the like can be used. As a method of casting the raw material metal, for example, an ingot casting method, a strip casting method, a book molding method, a centrifugal casting method, and the like may be mentioned. In case solidification segregation exist in the obtained raw material alloy, a homogenization treatment is carried out if needed. In case the homogenization treatment is carried out to the raw material alloy, it is carried out in vacuum or in inert gas atmosphere and held in a temperature of 700° C. or more and 1500° C. or less for one hour or longer. Thereby, the alloy for R-T-B based sintered magnet is melted and homogenized.

[Pulverization Step]

After the main phase alloy and the grain boundary alloy are produced, the main phase alloy and the grain boundary alloy are pulverized. After the main phase alloy and the grain boundary phase alloy are produced, these are pulverized separately into powders. Note that, the main phase alloy and the grain boundary phase alloy may be pulverized together, however from the point of suppressing a deviation of the composition, these are preferably pulverized separately.

The pulverization step can be carried out in two steps, that is a coarse pulverization step pulverizing until a particle size is several hundred μm to several mm or so, and a fine pulverization step pulverizing until a particle size is several μm or so.

(Coarse Pulverization Step)

The main phase alloy and the grain boundary phase alloy are coarsely pulverized until each of particle sizes are several hundred μm to several mm or so. Thereby, coarsely pulverized powders of the main phase alloy and the grain boundary phase alloy are obtained. After hydrogen is stored in the main phase alloy and the grain boundary phase alloy, hydrogen is released due to a different hydrogen storage amount between the main phases and the grain boundaries, and dehydrogenation is carried out which causes a self-collapsing like pulverization (hydrogen storage pulverization), thereby the coarse pulverization can be carried out. The added amount of nitrogen necessary for forming the R—O—C—N phase can be controlled by regulating the nitrogen gas concentration in the atmosphere of the dehydrogenation treatment during this hydrogen storage pulverization. An optimum nitrogen gas concentration differs depending on the composition and the like of the raw material alloy, for example it is preferably 200 ppm or more. Also, other than the above mentioned hydrogen storage pulverization, the coarse pulverization step may be carried out by using a coarse pulverizer such as a stamp mill, a jaw crusher, a brown mill, and the like, in inert gas atmosphere.

Also, in order to attain high magnetic properties, each step from the pulverization step to the sintering step which is described in below is preferably carried out in an atmosphere of a low oxygen concentration. The oxygen concentration is regulated by controlling an atmosphere of each step of production. If the oxygen concentration of each step of production is high, a rare earth element in the powders of main phase alloy and grain boundary alloy is oxidized and oxides of R are generated, which precipitate as oxides of R in the grain boundaries since these are not reduced during sintering, and Br of the obtained R-T-B based sintered magnet decreases. Therefore, for example, the oxygen concentration of each step is preferably 100 ppm or less.

(Fine Pulverization Step)

After coarsely pulverizing the main phase alloy and the grain boundary alloy, the obtained coarsely pulverized powders of main phase alloy and grain boundary alloy are finely pulverized until the average particle size is several μm or so. Thereby, the finely pulverized powders of main phase alloy and grain boundary alloy are obtained. By finely pulverizing the coarsely pulverized powders, the finely pulverized powders preferably having the particle size of 1 μm or more to 10 μm or less, more preferably 3 μm or more to 5 μm or less can be obtained.

Note that, in the present embodiment, the finely pulverized powders of main phase alloy and grain boundary alloy are pulverized separately thereby the finely pulverized powders are obtained. However, in the fine pulverization step, the coarsely pulverized powders of main phase alloy and grain boundary alloy may be mixed and then finely pulverized, thereby the finely pulverized powder may be obtained.

The fine pulverization is carried out by further pulverizing the coarsely pulverized powders using a fine pulverizer such as a jet mill, a ball mill, a vibrating mill, a wet attritor, and the like while regulating the condition such as a pulverization time and the like accordingly. A jet mill is a method of pulverization wherein a high pressure inert gas (for example, $N_2$ gas) is released from a narrow nozzle to generate a high speed gas flow, and this high speed gas flow accelerates the coarsely pulverized powders of main phase alloy and grain boundary alloy and makes the coarsely pulverized powders of main phase alloy and grain boundary alloy to collide against each other or collide the coarsely pulverized powders of main phase alloy and grain boundary alloy with a target or a container wall.

When finely pulverizing the coarsely pulverized powders of the main phase alloy and the grain boundary alloy, by adding a pulverization aid such as zinc stearate, oleic amide, and the like, the fine pulverized powders with high orientation can be obtained in a pressing step.

[Mixing Step]

After finely pulverizing the man phase alloy and the grain boundary alloy, all of the finely pulverized powders is mixed in a low oxygen atmosphere. Thereby, a mixed powder is obtained. The low oxygen atmosphere is, for example, inert gas atmosphere such as $N_2$ gas, Ar gas, and the like. A mixing ratio of the main phase alloy powder and the grain boundary alloy powder is preferably 80:20 or more and 97:3 or less in terms of mass ratio, and more preferably 90:10 or more and 97:3 or less in terms of mass ratio.

Also, in the pulverization step, when pulverizing the main phase alloy and the grain boundary alloy together, the mixing ratio is the same as in case of pulverizing the main phase alloy and the grain boundary alloy separately. That is, the mixing ratio of the main phase alloy and the grain boundary alloy is preferably 80:20 or more and 97:3 or less in terms of mass ratio, and more preferably 90:10 or more and 97:3 or less in terms of mass ratio.

The oxygen source and the carbon source are further added to the mixed powder in addition to the raw material alloy. By adding the oxygen source and the carbon source in a predetermined amount to the mixed powder, the desired R—O—C—N concentrated part can be formed in the grain boundaries of the obtained R-T-B based permanent magnet.

As the oxygen source, the powder including oxides of M1 can be used. M1 is an element which has higher standard free energy of formation for producing oxides than a rare earth element R. As M1, for example, Al, Fe, Co, Zr, and the like may be mentioned, and other elements may be used. Also, the metal particle having oxidized surface may be used as well.

As the carbon source, carbides of M2, a powder including carbon, or organic compounds which generate carbon by thermal decomposition can be used. M2 is an element which has higher standard free energy of formation for producing carbides than a rare earth element R. As the powder including carbon, graphite, carbon black, and the like may be mentioned. As M2, for example Si, Fe, and the like may be mentioned, and other elements may be used. Also, powder including carbides such as cast iron and the like can be used as the carbon source.

The optimum added amounts of oxygen source and carbon source differ depending on the composition of the raw material alloy, particularly of the amount of a rare earth element. Therefore, in order to obtain the desired R—O—C—N concentrated part, the added amounts of oxygen source and carbon source may be regulated depending on the composition of the alloy used. If the added amounts of oxygen source and carbon source are larger than the necessary amount, (O/R) of the R—O—C—N concentrated part increases too much, and HcJ of the obtained R-T-B based permanent magnet tends to easily decrease. Further, the R—O concentrated part, the R—C concentrated part, and the like are formed in the grain boundaries, and the corrosion resistance also tends to easily decrease. If the added amounts of oxygen source and carbon source are less than the necessary amount, the R—O—C—N concentrated part of the desired composition is less likely to be obtained.

The method of adding the oxygen source and carbon source is not particularly limited, and preferably these are added when mixing the finely pulverized powders, or added to the coarsely pulverized powders before the fine pulverization.

Also, in the present embodiment, nitrogen is added by controlling the atmospheric nitrogen concentration during the dehydrogenation treatment in the coarse pulverization step, but instead of this, powder including nitrides of M3 may be added as nitrogen source. M3 is an element which has higher standard free energy of formation for producing nitrides than a rare earth element R. As M3, for example Si, Fe, B, and the like may be mentioned, but it is not limited thereto.

[Pressing Step]

After mixing the main phase alloy powder and the grain boundary alloy powder, the mixed powder is pressed into a desired shape. Thereby, the green compact is obtained. The pressing step is carried out by filling the mixed powder of main phase alloy powder and grain boundary alloy powder in a press mold held by an electromagnet and then applying a pressure, thereby forms desired shape. Here, by pressurizing while applying a magnetic field, a predetermined orientation of the raw material powder is formed, and pressing is done in the magnetic field while crystal axis is oriented. The obtained green compact is oriented in a specific direction; hence the R-T-B based permanent magnet having high magnetic anisotropy is obtained.

[Sintering Step]

The green compact having a desired shape obtained by pressing in a magnetic field is sintered in a vacuum or in inert gas atmosphere, and the R-T-B based permanent magnet is obtained. A sintering temperature needs to be regulated depending on various conditions such as a composition, a pulverization method, a difference between particle size and particle size distribution, and the like, and for example sintering is done by heating the green compact in a vacuum or in inert gas atmosphere at 1000° C. or higher and 1200° C. or lower for 1 hour or more to 10 hours or less. Thereby, the mixed powder undergoes a liquid phase sintering, and the R-T-B based permanent magnet having improved volume ratio of the main phases can be obtained. Also, the R-T-B based permanent magnet after sintering is preferably rapidly cooled from the point to improve the production efficiency.

In case of measuring the magnetic properties at this point, the aging treatment is carried out. After the green compact is sintered, the R-T-B based permanent magnet is carried out with the aging treatment. After sintering, the obtained R-T-B based permanent magnet is maintained in a temperature lower than the sintering temperature, thereby the aging treatment is done to the R-T-B based permanent magnet. The condition of the aging treatment is regulated accordingly depending on the number of times carrying out the aging treatment such as a two-step heating which heats for 1 hour to 3 hours at temperature of 700° C. or higher and 900° C. or lower and further heating for 1 hour to 3 hours at temperature of 500° C. to 700° C., or a one-step heating which heats for 1 hour to 3 hours at temperature around 600° C. By carrying out such aging treatment, the magnetic properties of R-T-B based permanent magnet can be improved. Also, the aging treatment may be carried out after the machining step.

After carrying out the aging treatment to the R-T-B based permanent magnet, the R-T-B based permanent magnet is rapidly cooled in Ar gas atmosphere. Thereby, the R-T-B based permanent magnet according to the present embodiment can be obtained. A cooling rate is not particularly limited, and preferably it is 30° C./min or faster.

[Machining Step]

The obtained R-T-B based permanent magnet may be machined into a desired shape depending on the needs. The method of machining may be, for example a shaping process such as cutting, grinding, and the like, a chamfering process such as barrel polishing, and the like.

[Diffusing Step]

A step for diffusing a heavy rare earth element may be further carried out to the grain boundaries of the R-T-B based permanent magnet. Due to this step, the structure of the R—O—C—N concentrated part could easily have a core-shell structure.

First, a pre-treatment is carried out to the R-T-B based permanent magnet. By carrying out an appropriate pre-treatment, a surface condition and a cleanness of the R-T-B based permanent magnet before the diffusion can be controlled, and the structure of the R—O—C—N concentrated part can easily have a core-shell structure. A method of pre-treatment is not particularly limited. For example, a method of immersing in a mixed solution of acids and alcohols for appropriate time may be mentioned. Any acids can be used, and for example, nitric acid may be mentioned. Any alcohols can be used, and for example, ethanol may be mentioned. For example, the pre-treatment can be carried out by immersing in an etching solution formed by blending 1N nitric acid and 97% alcohol in a mass ratio of 0.5:100 to 5:100 for 1 to 10 minutes. Note that, in case the concentration of acids is too low or the time of immersing is too short, the surface may not be cleaned enough, and even if diffusion is carried out, the covering ratio of the shell part becomes difficult to improve. This is because the heavy rare earth element adhered is difficult to diffuse into the Nd—Fe—B permanent magnet during a heat diffusion step. On the contrary, in case the concentration of acids is too high or the time of immersing is too long, the heavy rare earth element diffuses too rapidly, and the R—O—C—N concentrated part having uniform concentration of the heavy rare earth element tends to be formed.

The diffusion can be carried out by a method of carrying out a heat treatment after adhering the compounds including a heavy rare earth element to the surface of the R-T-B based permanent magnet, or by a method of carrying out a heat treatment to the R-T-B based permanent magnet in an atmosphere including a vapor of a heavy rare earth element.

Note that, a method of adhering a heavy rare earth element is not particularly limited. For example, methods of using a vapor deposition, a spattering, an electrodeposition, a spray coating, a brush coating, a jet dispenser, a nozzle, a screen printing, a squeeze printing, a sheet method, and the like may be mentioned.

For example, in case of diffusing Tb as a heavy rare earth element, by appropriately controlling the coating amount of Tb, diffusion temperature, and diffusion time, the R—O—C—N concentrated part easily forms a core-shell structure, and the covering ratio of the shell part can be controlled.

In case of adhering a heavy rare earth element by coating, generally a paste having a solvent and a heavy rare earth element compound including a heavy rare earth element is coated. A condition of solvent is not particularly limited. Also, as the heavy rare earth element compound, alloys, oxides, halides, hydroxides, hydrides, and the like may be mentioned, and particularly hydrides are preferably used. As hydrides of a rare earth element, $DyH_2$, $TbH_2$, hydrides of Dy—Fe, or hydrides of Tb—Fe may be mentioned. Particularly, $DyH_2$ or $TbH_2$ is preferable.

The heavy rare earth element compound is preferably in particle form. Also, the average particle size is preferably 100 nm to 50 μm, and more preferably 1 μm to 10 μm.

The solvent used for the paste is preferably obtained by uniformly dispersing the heavy rare earth compound without dissolving it. For example, alcohols, aldehydes, ketones, and the like may be mentioned, and among these, ethanol is preferable.

The content of the heavy rare earth element compound in the paste is not particularly limited. For example, it maybe 10 to 50 mass %. The paste may further include other components besides the heavy rare earth element compound if necessary. For example, a dispersant and the like for preventing the aggregation of the heavy rare earth element compound particles may be mentioned.

The diffusion step according to the present embodiment has no particular limitation for the number of faces of the R-T-B based permanent magnet where the paste including the heavy rare earth element compound is adhered. For example, it may be coated to all of the faces, or only to the two faces which are the largest face and the face opposing the largest face. Also, if necessary, a masking may be done to the face where the paste is not coated.

The coating amount of Tb can for example be 0.3 wt % or more to 0.9 wt % or less with respect to 100 wt % of the entire of R-T-B based permanent magnet. Also, temperature during the diffusion is 800° C. or higher and 950° C. or lower for 5 hours or more to 40 hours or less.

Other than the surface condition and cleanness of the R-T-B based permanent magnet before diffusion, by regulating the conditions of the diffusing step such as the adhering amount of RH, the diffusion temperature, the diffusion time, the heat treatment pattern, and the like, the R—O—C—N concentrated part can easily have the core-shell structure.

[Aging Treatment Step]

After the diffusing step, the aging treatment is carried out to the R-T-B based permanent magnet. After diffusion, the obtained R-T-B based permanent magnet is maintained under a temperature lower than in the diffusing step, thereby the aging treatment of the R-T-B based permanent magnet is carried out. The condition of the aging treatment is regulated accordingly depending on the number of times of carrying out the aging treatment such as a two-step heating which heats for 1 hour to 3 hours at temperature of 700° C. or higher and 900° C. or lower and further heating for 1 hour to 3 hours at temperature of 500° C. to 700° C., or a one-step heating which heats for 1 hour to 3 hours at temperature around 600° C. By carrying out such aging treatment, the magnetic properties of the R-T-B based permanent magnet can be improved.

[Cooling Step]

After carrying out the aging treatment to the R-T-B based permanent magnet, it is rapidly cooled in Ar gas atmosphere. Thereby, the R-T-B based permanent magnet according to the present embodiment can be obtained. The cooling rate is not particularly limited, and preferably it is 30° C./min or more.

[Surface Treatment Step]

The R-T-B based permanent magnet is obtained by the above mentioned steps, and it may be carried out with a surface treatment such as a plating, a resin coating, an oxidation treatment, a chemical conversion treatment, and the like. Thereby, the corrosion resistance can be further improved.

Note that, the present embodiment carries out the machining step and the surface treatment step, however these steps may not be necessary.

As such, the R-T-B based permanent magnet according to the present embodiment is produced, and the treatments are completed. Also, the magnet product is obtained by magnetizing.

The R-T-B based permanent magnet according to the present embodiment obtained as such has the R—O—C—N concentrated part in the grain boundaries. Further, at least part of the R—O—C—N concentrated part has the core-shell structure, and the coating ratio of the shell part is 45% or more in average. The R-T-B based permanent magnet according to the present embodiment has the above mentioned constitution, thereby has an excellent corrosion resistance and also good magnetic properties.

The R-T-B based permanent magnet obtained as such has a high corrosion resistance thus it can be used for long period of time when used as a magnet of a rotary machine such as motor and the like, thus provides highly reliable R-T-B based permanent magnet. The R-T-B based permanent magnet according to the present embodiment is suitably used as a magnet of surface magnet type (Surface Permanent Magnet: SPM) motor wherein a magnet is attached on the surface of a rotor, an interior magnet embedded type (Interior Permanent Magnet: IPM) motor such as inner rotor type brushless motor, PRM (Permanent magnet Reluctance Motor), and the like. Specifically, the R-T-B based permanent magnet according to the present embodiment is suitably used for a spindle motor for a hard disk rotary drive or a voice coil motor of a hard disk drive, a motor for an electric vehicle or a hybrid car, an electric power steering motor for an automobile, a servo motor for a machine tool, a motor for vibrator of a cellular phone, a motor for a printer, a motor for a magnet generator, and the like.

Hereinabove, the preferable embodiment of the R-T-B based permanent magnet of the present invention is described, but the R-T-B based permanent magnet of the present invention is not to be limited thereto. The R-T-B based permanent magnet of the present invention can be variously modified and various combinations are possible within the scope of the invention, and same applies to other rare earth element based magnet.

For example, the R-T-B based permanent magnet according to the present invention is not limited to the R-T-B based permanent magnet produced by sintering as mentioned in above. Instead of sintering, the R-T-B based permanent magnet may be produced by carrying out a hot-forming and a hot-working.

When a hot-forming is carried out which applies pressure while heating to a cold-formed body obtained by pressing the raw material powder at room temperature, pores remaining in the cold-formed body disappear, and densification can be done without sintering. Further, by carrying out a hot-extrusion as a hot-working to the hot-formed body obtained by a hot-forming, the R-T-B based permanent magnet having desired shape and also having magnetic anisotropy can be obtained. Also, in case the R-T-B based permanent magnet has the R—O—C—N concentrated part, the R-T-B based permanent magnet according to the present invention can be obtained by diffusing a heavy rare earth element under appropriate condition.

EXAMPLES

Next, the present invention is described based on specific examples, however the present invention is not limited to the below examples.

Examples 1-1- to 1-12, Comparative Examples 1-1 to 1-6

<Production of R-T-B Based Permanent Magnet>

First, an alloy for sintered body (raw material alloy) having the following composition was produced by a strip casting (SC) method in order to obtain the R-T-B based permanent magnet having a composition of 24.8 wt % Nd-5.9 wt % Pr-1.0 wt % Co-0.20 wt % Al-0.15 wt % Cu-0.20 wt % Zr-1.00 wt % B-bal.Fe. The raw material alloy was produced by two kinds of alloys which are a main phase alloy mainly forming main phases of a magnet and a grain boundary alloy mainly forming grain boundaries.

Next, hydrogen pulverization (coarse pulverization) of the raw material alloys was carried out by absorbing hydrogen in each of the raw material alloys at room temperature, and then dehydrogenation treatment was carried out for 1 hour at 600° C. The dehydrogenation treatment was carried out in a mixed gas atmosphere of Ar gas-nitrogen gas, and by changing a concentration of nitrogen gas in the atmosphere as shown in Table 1; an added amount of nitrogen was controlled. Note that, each example and comparative example was carried out under an atmosphere having oxygen concentration of less than 50 ppm for each step (fine pulverization and pressing) from this hydrogen pulverization treatment to sintering.

Next, before carrying out the fine pulverization after the hydrogen pulverization, 0.1 wt % of oleic amide was added as a pulverization aid to the coarsely pulverized powder of each of the raw material alloys using a Nauta mixer. Then, the fine pulverization was carried out by high pressure $N_2$ gas using a jet mill, and obtained finely pulverized powders having an average particle size of 4.0 μm or so.

Then, the finely pulverized powder of main phase alloy and the finely pulverized powder of grain boundary alloy were mixed in a predetermined ratio, and also alumina particles as an oxygen source and carbon black particles as an carbon source were added in an amount shown in Table 1. These were mixed using a Nauta mixer, and a mixed powder which is the raw material powder of R-T-B based permanent magnet was prepared.

The obtained mixed powder was filled in a press mold placed in an electromagnet, a pressure of 120 MPa was applied while applying a magnetic field of 1200 kA/m, and a green compact was obtained by pressing in a magnetic field. Then, the obtained green compact was sintered by maintaining it in vacuumed atmosphere at 1060° C. for 4 hours, followed by rapid cooling, thereby a sintered body (R-T-B based sintered magnet) having the above mentioned composition was obtained. Then, the obtained sintered body was carried out with a two-step aging treatment of 1 hour at 850° C. and 2 hours at 540° C. (both in Ar gas atmosphere), followed by rapid cooling, thereby the R-T-B based permanent magnet of Examples 1-1 to 1-6 and Comparative examples 1-1 to 1-6 were obtained. Note that, the R-T-B based permanent magnet had a substantially rectangular parallelepiped shape of 15 mm×10 mm×4 mm.

<Diffusion of Heavy Rare Earth Element>

Next, 1 N nitric acid and 97% ethanol were mixed in a mass ratio of 3:100 to prepare a mixed solution. Further, the R-T-B based permanent magnet of the examples and the comparative examples were immersed in the mixed solution for an etching time indicated in Table 1. Then, a treatment of immersing in 97% ethanol for 1 minute was carried out. The treatment of immersing in 97% ethanol for 1 minute was carried out twice. Then, the R-T-B based permanent magnet was washed, and dried.

Also, a Tb including paste for coating the R-T-B based permanent magnet was prepared. First, a $TbH_2$ fine powder was prepared by finely pulverizing a $TbH_2$ raw material powder by a jet mill which uses $N_2$ gas. Also, 99 parts by mass of ethanol and 1 part by mass of polyvinyl alcohol were mixed to prepare an alcohol solvent. Further, 30 parts by mass of the $TbH_2$ fine powder and 70 parts by mass of the alcohol solvent were mixed to disperse the $TbH_2$ fine powder in the alcohol solvent and formed a paste, thereby the Tb including paste was prepared.

The Tb including paste was coated by brushing to two faces having 15 mm×10 mm of the R-T-B based permanent magnet so that the total amount of the Tb coated to the two faces was the amount shown in Table 1. Next, a diffusion treatment was carried out at a diffusion temperature for a diffusion time shown in Table 1. Further, the aging treatment was carried out for 1 hour at 500° C. after the diffusion treatment.

[Composition]

(Observation of Element Distribution)

A cross section surface of the obtained R-T-B based permanent magnet was ground by ion milling to remove effects of oxidation and the like of the outermost surface, an element distribution of the cross section of the R-T-B based permanent magnet was observed and analyzed by EPMA (Electron Probe Micro Analyzer). For an area of 50 μm×50 μm of the R-T-B based permanent magnet of the examples and the comparative examples, the composition was observed by EPMA, and an elemental mapping (256 points×256 points) was done by EPMA. As a specific example, FIG. 2 shows a backscattered electron image and observation results of each element of Tb, C, Nd, Fe, O, and N by EPMA of Example 1-5, and FIG. 3 shows a backscattered electron image and observation results of each element of Tb, C, Nd, Fe, O, and N by EPMA of Comparative example 1-5.

(Calculation of Area Ratio of R—O—C—N Concentrated Part Occupying Grain Boundaries)

The area ratio of the R—O—C—N concentrated part occupying the grain boundaries was calculated in following steps. Note that, in below explanation, the area of R—O—C—N concentrated part may be referred as a, and the area of a grain boundary part may be referred as β.

(1) The backscattered electron image was binalized at a predetermined level, and the main phase part and the grain boundary part were identified, then the area (β) of the grain boundary part was calculated. Note that, the banalization was carried out based on a signal intensity of the backscattered electron image. It is known that the signal intensity of the backscattered electron image becomes stronger as the content of the element having large atomic number increases. There are more rare earth elements having larger atomic number in the grain boundary part than in the main phase part, and it is a method generally done to identify the main phase part and the grain boundary part by binalizing at a predetermined level. Also, when measuring, in some case the grain boundary between two grains cannot be seen even after banalization. In this case, an area of the grain boundary between two grains is within a margin of error, thus this does not affect a numerical range when calculating the area (β) of the grain boundary part.

(2) From a mapping data of a characteristic X-ray intensity of Nd, O, C, and N obtained from EPMA, an average value of the characteristic X-ray intensity and a standard deviation of the characteristic X-ray intensity of each element of Nd, O, C, and N in the main phase part identified in the above (1) were calculated, and thereby (an average value+three times of the standard deviation of the of the characteristic X-ray intensity) of each element in the main phase part was calculated.

(3) From a mapping data of the characteristic X-ray intensity of Nd, O, C, and N obtained from EPMA, for each element, an area having the characteristic X-ray intensity of equal or larger than (an average value+three times of the standard deviation of the of the characteristic X-ray intensity) in the main phase part obtained in above (2) was identified. For each element, the area having equal or larger characteristic X-ray intensity than (an average value+three times of the standard deviation of the of the characteristic X-ray intensity) in the main phase part was defined as the part having higher concentration of the element than in the main phase part.

(4) When the area identified as the grain boundary by the above (1) and the area having higher concentrations of each of Nd, O, C, and N identified by the above (3) all overlap, this area was defined as the R—O—C—N concentrated part in the grain boundaries, and the area (a) of this part was calculated. Note that, an observation result of Pr by EPMA was confirmed to have similar tendency as an observation result of Nd by EPMA. That is, the area having higher concentration of Nd than in the main phase part was confirmed to have higher concentration of R than in the main phase part.

(5) The area (a) of the R—O—C—N concentrated part calculated from the above (4) was divided by the area (β) of the grain boundary part calculated from the above (1), thereby an area ratio (α/β) of the R—O—C—N concentrated part occupying the grain boundaries was calculated. The results are shown in Table 2.

(Confirmation of R—O—C—N Concentrated Part Having Core-Shell Structure and Calculation of Covering Ratio)

Regarding the area determined as the R—O—C—N concentrated part by the above method, from the mapping data of a characteristic X-ray intensity of Tb obtained by EPMA, the area having equal or larger characteristic X-ray intensity than (an average value+three times of the standard deviation of the of the characteristic X-ray intensity) of Tb in the main phase part obtained by above (2) was identified. The area having equal or larger characteristic X-ray intensity of Tb than (an average value+three times of the standard deviation of the of the characteristic X-ray intensity) of each element in the main phase part was defined as the area having higher concentration of Tb than in the main phase part.

Further, for each example and comparative example, it was confirmed that at least part of the R—O—C—N concentrated part had the core-shell structure wherein a Tb concentration in the shell part was higher than a Tb concentration in the core part. Further, for each and every R—O—C—N concentrated part included in the observation area of 50 μm×50 μm, the covering ratio was measured, and the average was calculated, thereby the covering ratio of each R-T-B based permanent magnet was measured. The results are shown in Table 2.

(Calculation of Ratio (O/R) of O Atom with Respect to R Atom in the R—O—C—N Concentrated Part, and Ratio (N/R) of N Atom with Respect to R Atom)

For the composition of the R—O—C—N concentrated part, a quantitative analysis was carried out. The quantitative analysis of each element was carried out using EPMA to the R—O—C—N concentrated part identified by EPMA mapping, and from the obtained concentration of each element, the ratio (O/R) of O atom with respect to R atom was calculated. For each sample, the measurements of five places were taken, and the average value thereof was defined as the ratio (O/R) of the sample. Similarly, the ratio (N/R) of N atom with respect to R atom was calculated. For each sample, the measurements of five places were taken, and the average value thereof was defined as the ratio (N/R) of the sample. The ratios (O/R) and (N/R) of each R-T-B based permanent magnet are shown in Table 2.

(Analysis of Oxygen Amount and Carbon Amount)

The oxygen amount was measured using an inert gas fusion—non-dispersive infrared absorption method, a carbon amount was measured using a combustion in an oxygen airflow—infrared absorption method, and a nitrogen amount was measured using an inert gas fusion—thermal conductivity method, thereby the oxygen amount and the carbon amount in the R-T-B based permanent magnet were analyzed. The analysis results of the oxygen amount and the carbon amount in each R-T-B based permanent magnet are shown in Table 2.

(Measurement of Magnetic Properties)

As the magnetic properties of each R-T-B based permanent magnet obtained, Br and HcJ were measured. The measurement results of Br and HcJ of each R-T-B based permanent magnet are shown in Table 2. Note that, a BH tracer was used to measure Br and HcJ. In the present examples, Br of 1300 mT or more was considered good, and Br of 1400 mT or more was considered excellent. Also, HcJ of 1900 kA/m or more was considered good, and HcJ of 2000 kA/m or more was considered excellent.

(Corrosion Resistance)

Each R-T-B based permanent magnet obtained was processed into a plate form of 13 mm×8 mm×2 mm. Then, this plate form magnet was left in a saturated water vapor atmosphere of 100% relative humidity at 120° C. and 2 atmospheric pressure, and the time of powder fall, that is the time which took the magnet to start to collapse by corrosion was evaluated. The time when each R-T-B based permanent magnet started to collapse is shown in Table 2. If the powder fall did not occur after leaving for 1200 hours, then it was considered that the corrosion did not occur. In the present examples, the corrosion resistance was considered good in case it took 900 hours or longer to start a powder fall, and in case the powder fall did not occur for 1200 hours, then it was considered excellent.

TABLE 1

| | Dehydrogenation | post-adding | | Diffusion | | | |
|---|---|---|---|---|---|---|---|
| | $N_2$ concentration (ppm) | Alumina (mass %) | Carbon black (mass %) | Etching time (min) | Coating amount of Tb (mass %) | Diffusion temperature (° C.) | Diffusion time (hr) |
| Example 1-1 | 200 | 0.10 | 0.01 | 5 | 0.6 | 880 | 15 |
| Example 1-2 | 200 | 0.13 | 0.01 | 5 | 0.6 | 880 | 15 |
| Example 1-3 | 300 | 0.17 | 0.02 | 5 | 0.6 | 880 | 15 |
| Example 1-4 | 300 | 0.20 | 0.02 | 5 | 0.6 | 880 | 15 |
| Example 1-5 | 350 | 0.30 | 0.03 | 5 | 0.6 | 880 | 15 |
| Example 1-6 | 350 | 0.35 | 0.03 | 5 | 0.6 | 880 | 15 |
| Example 1-7 | 200 | 0.13 | 0.01 | 5 | 0.3 | 880 | 15 |
| Example 1-2 | 200 | 0.13 | 0.01 | 5 | 0.6 | 880 | 15 |
| Example 1-8 | 200 | 0.13 | 0.01 | 5 | 0.9 | 880 | 15 |
| Example -19 | 200 | 0.13 | 0.01 | 3 | 0.6 | 880 | 15 |
| Example 1-2 | 200 | 0.13 | 0.01 | 5 | 0.6 | 880 | 15 |
| Example 1-10 | 200 | 0.13 | 0.01 | 10 | 0.6 | 880 | 15 |
| Example 1-11 | 200 | 0.13 | 0.01 | 5 | 0.6 | 930 | 5 |
| Example 1-2 | 200 | 0.13 | 0.01 | 5 | 0.6 | 880 | 15 |
| Example 1-12 | 200 | 0.13 | 0.01 | 5 | 0.6 | 830 | 40 |
| Comparative example 1-1 | 200 | 0.10 | 0.01 | 1 | 0.8 | 900 | 12 |
| Comparative example 1-2 | 200 | 0.13 | 0.01 | 1 | 0.8 | 900 | 12 |
| Comparative example 1-3 | 300 | 0.17 | 0.02 | 1 | 0.8 | 900 | 12 |
| Comparative example 1-4 | 300 | 0.20 | 0.02 | 1 | 0.8 | 900 | 12 |
| Comparative example 1-5 | 350 | 0.30 | 0.03 | 1 | 0.8 | 900 | 12 |
| Comparative example 1-6 | 350 | 0.35 | 0.03 | 1 | 0.8 | 900 | 12 |

TABLE 2

| | Area ratio of R-O-C-N concentrated part (%) | Covering ratio (%) | O/R | N/R | Oxygen amount (ppm) | Carbon amount (ppm) | Br (mT) | HcJ (kA/m) | Corrosion resistance (hr) |
|---|---|---|---|---|---|---|---|---|---|
| Example 1-1 | 16 | 71 | 0.44 | 0.45 | 920 | 890 | 1435 | 1915 | 1200 |
| Example 1-2 | 27 | 72 | 0.53 | 0.43 | 1140 | 930 | 1433 | 1918 | 1200 |
| Example 1-3 | 38 | 74 | 0.54 | 0.38 | 1280 | 990 | 1431 | 1921 | 1200 |
| Example 1-4 | 46 | 68 | 0.66 | 0.35 | 1400 | 1010 | 1433 | 1916 | 1100 |
| Example 1-5 | 63 | 59 | 0.72 | 0.29 | 1690 | 1090 | 1433 | 1911 | 1000 |
| Example 1-6 | 71 | 45 | 0.75 | 0.25 | 1990 | 1150 | 1429 | 1905 | 1000 |
| Example 1-7 | 26 | 53 | 0.54 | 0.42 | 1130 | 930 | 1438 | 1853 | 1000 |
| Example 1-2 | 27 | 72 | 0.53 | 0.43 | 1140 | 930 | 1433 | 1918 | 1200 |
| Example 1-8 | 25 | 77 | 0.55 | 0.45 | 1170 | 930 | 1425 | 1931 | 1200 |
| Example 1-9 | 25 | 48 | 0.51 | 0.42 | 1140 | 930 | 1431 | 1908 | 900 |
| Example 1-2 | 27 | 72 | 0.53 | 0.43 | 1140 | 930 | 1433 | 1918 | 1200 |
| Example 1-10 | 27 | 75 | 0.53 | 0.42 | 1140 | 930 | 1434 | 1921 | 1200 |
| Example 1-11 | 29 | 77 | 0.53 | 0.42 | 1140 | 930 | 1435 | 1919 | 1200 |
| Example 1-2 | 27 | 72 | 0.53 | 0.43 | 1140 | 930 | 1433 | 1918 | 1200 |
| Example 1-12 | 25 | 48 | 0.53 | 0.43 | 1140 | 930 | 1434 | 1880 | 900 |
| Comparative example 1-1 | 15 | 10 | 0.43 | 0.41 | 910 | 880 | 1434 | 1895 | 600 |
| Comparative example 1-2 | 28 | 5 | 0.42 | 0.43 | 1110 | 910 | 1429 | 1889 | 600 |
| Comparative example 1-3 | 35 | 8 | 0.48 | 0.36 | 1250 | 1000 | 1431 | 1881 | 600 |
| Comparative example 1-4 | 43 | 9 | 0.51 | 0.33 | 1350 | 1000 | 1431 | 1875 | 700 |
| Comparative example 1-5 | 61 | 8 | 0.65 | 0.28 | 1680 | 1050 | 1428 | 1871 | 700 |
| Comparative example 1-6 | 65 | 3 | 0.66 | 0.23 | 1910 | 1140 | 1430 | 1865 | 700 |

According to Table 1 and Table 2, Examples 1-1 to 1-12 had the R—O—C—N concentrated part having the core-shell structure and the covering ratio was 45% or more. Examples 1-1 to 1-12 exhibited good magnetic properties and corrosion resistance. Comparative examples 1-1 to 1-6 which were produced under the same condition as Examples 1-1 to 1-6 except for changing the diffusion condition had the covering ratio of less than 45%. Further, each example showed excellent Br and HcJ compared to the comparative examples carried out under the same condition except for the etching time. Furthermore, Examples 1-1 to 1-6 showed good corrosion resistance, but Comparative examples 1-1 to 1-6 showed poor corrosion resistance.

Examples 2-0 to 2-28, and Comparative Examples 2-0 to 2-3

In Examples 2-0 to 2-28 and Comparative examples 2-0 to 2-3, the raw material alloy was produced so that the R-T-B based permanent magnet having the composition shown in Table 3 can be obtained. $N_2$ concentration during dehydrogenation was 200 ppm, and the added amount of alumina was 0.13 wt %, the added amount of carbon black was 0.01 wt %. Also, the coating amount of Tb during the diffusion treatment was 0.8 wt %, the diffusion temperature was 900° C., and the diffusion time was 12 hours. The etching time was 5 minutes for Examples 2-0 to 2-28, and 2 minutes for Comparative examples 2-0 to 2-3. Other than as mentioned in above, the same conditions as Example 1-2 were employed. The results are shown in Table 3 and Table 4.

TABLE 3

| | Composition of magnet (mass %) | | | | | | | | | |
|---|---|---|---|---|---|---|---|---|---|---|
| | Nd | Dy | Pr | Total R | Co | Al | Cu | Zr | B | Fe |
| Example 2-0 | 24.8 | 0.0 | 5.9 | 30.7 | 1.0 | 0.20 | 0.15 | 0.20 | 1.0 | bal. |
| Example 2-1 | 24.0 | 1.0 | 5.7 | 30.7 | 1.0 | 0.20 | 0.15 | 0.20 | 1.0 | bal. |
| Example 2-2 | 23.2 | 2.0 | 5.5 | 30.7 | 1.0 | 0.20 | 0.15 | 0.20 | 1.0 | bal. |
| Example 2-3 | 22.4 | 3.0 | 5.3 | 30.7 | 1.0 | 0.20 | 0.15 | 0.20 | 1.0 | bal. |
| Exaple 2-8 | 24.8 | 0.0 | 5.9 | 30.7 | 0.0 | 0.20 | 0.15 | 0.20 | 1.0 | bal. |
| Example 2-9 | 24.8 | 0.0 | 5.9 | 30.7 | 0.1 | 0.20 | 0.15 | 0.20 | 1.0 | bal. |
| Example 2-10 | 24.8 | 0.0 | 5.9 | 30.7 | 0.3 | 0.20 | 0.15 | 0.20 | 1.0 | bal. |
| Example 2-0 | 24.8 | 0.0 | 5.9 | 30.7 | 1.0 | 0.20 | 0.15 | 0.20 | 1.0 | bal. |
| Example 2-11 | 24.8 | 0.0 | 5.9 | 30.7 | 1.5 | 0.20 | 0.15 | 0.20 | 1.0 | bal. |
| Example 2-12 | 24.8 | 0.0 | 5.9 | 30.7 | 2.5 | 0.20 | 0.15 | 0.20 | 1.0 | bal. |
| Example 2-13 | 24.8 | 0.0 | 5.9 | 30.7 | 3.0 | 0.20 | 0.15 | 0.20 | 1.0 | bal. |
| Example 2-14 | 24.8 | 0.0 | 5.9 | 30.7 | 4.0 | 0.20 | 0.15 | 0.20 | 1.0 | bal. |
| Example 2-23a | 24.8 | 0.0 | 5.9 | 30.7 | 1.0 | 0.20 | 0.15 | 0.05 | 1.0 | bal. |
| Example 2-23a | 24.8 | 0.0 | 5.9 | 30.7 | 1.0 | 0.20 | 0.15 | 0.07 | 1.0 | bal. |
| Example 2-0 | 24.8 | 0.0 | 5.9 | 30.7 | 1.0 | 0.20 | 0.15 | 0.20 | 1.0 | bal. |
| Example 2-24 | 24.8 | 0.0 | 5.9 | 30.7 | 1.0 | 0.20 | 0.15 | 0.70 | 1.0 | bal. |
| Example 2-24a | 24.8 | 0.0 | 5.9 | 30.7 | 1.0 | 0.20 | 0.15 | 1.00 | 1.0 | bal. |
| Example 2-25 | 24.8 | 0.0 | 5.9 | 30.7 | 1.0 | 0.20 | 0.15 | 0.20 | 0.7 | bal. |
| Example 2-26 | 24.8 | 0.0 | 5.9 | 30.7 | 1.0 | 0.20 | 0.15 | 0.20 | 0.8 | bal. |
| Example 2-0 | 24.8 | 0.0 | 5.9 | 30.7 | 1.0 | 0.20 | 0.15 | 0.20 | 1.0 | bal. |
| Example 2-27 | 24.8 | 0.0 | 5.9 | 30.7 | 1.0 | 0.20 | 0.15 | 0.20 | 1.2 | bal. |
| Example 2-28 | 24.8 | 0.0 | 5.9 | 30.7 | 1.0 | 0.20 | 0.15 | 0.20 | 1.5 | bal. |
| Comparative example 2-0 | 24.8 | 0.0 | 5.9 | 30.7 | 1.0 | 0.20 | 0.15 | 0.20 | 1.0 | bal. |
| Comparative example 2-1 | 24.0 | 1.0 | 5.7 | 30.7 | 1.0 | 0.20 | 0.15 | 0.20 | 1.0 | bal. |
| Comparative example 2-2 | 23.2 | 2.0 | 5.5 | 30.7 | 1.0 | 0.20 | 0.15 | 0.20 | 1.0 | bal. |
| Comparative examle 2-3 | 22.4 | 3.0 | 5.3 | 30.7 | 1.0 | 0.20 | 0.15 | 0.20 | 1.0 | bal. |

TABLE 4

| | Area ratio of R-O-C-N concentrated part (%) | Covering ratio (%) | O/R | N/R | Oxygen amount (ppm) | Carbon amount (ppm) | Br (mT) | HcJ (kA/m) | Corrosion resistance (hr) |
|---|---|---|---|---|---|---|---|---|---|
| Example 2-0 | 27 | 73 | 0.53 | 0.44 | 1140 | 930 | 1435 | 1928 | 1200 |
| Example 2-1 | 25 | 68 | 0.52 | 0.44 | 1130 | 930 | 1410 | 2061 | 1100 |
| Example 2-2 | 26 | 65 | 0.53 | 0.43 | 1140 | 920 | 1383 | 2205 | 1100 |
| Example 2-3 | 25 | 55 | 0.55 | 0.41 | 1160 | 930 | 1355 | 2325 | 900 |
| Example 2-8 | 30 | 71 | 0.60 | 0.45 | 1170 | 930 | 1425 | 1904 | 900 |
| Example 2-9 | 28 | 71 | 0.54 | 0.45 | 1150 | 920 | 1432 | 1928 | 1100 |
| Example 2-10 | 28 | 72 | 0.54 | 0.44 | 1150 | 920 | 1433 | 1931 | 1200 |
| Example 2-0 | 27 | 73 | 0.53 | 0.44 | 1140 | 930 | 1435 | 1928 | 1200 |
| Example 2-11 | 26 | 74 | 0.52 | 0.45 | 1140 | 920 | 1438 | 1932 | 1200 |
| Example 2-12 | 24 | 74 | 0.51 | 0.45 | 1130 | 930 | 1431 | 1948 | 1200 |
| Example 2-13 | 23 | 74 | 0.51 | 0.44 | 1130 | 930 | 1415 | 1941 | 1200 |
| Example 2-14 | 23 | 75 | 0.50 | 0.45 | 1120 | 930 | 1401 | 1912 | 1200 |
| Example 2-23a | 23 | 74 | 0.52 | 0.45 | 1140 | 920 | 1439 | 1912 | 1100 |

TABLE 4-continued

| | Area ratio of R-O-C-N concentrated part (%) | Covering ratio (%) | O/R | N/R | Oxygen amount (ppm) | Carbon amount (ppm) | Br (mT) | HcJ (kA/m) | Corrosion resistance (hr) |
|---|---|---|---|---|---|---|---|---|---|
| Example 2-23 | 26 | 73 | 0.52 | 0.44 | 1140 | 930 | 1937 | 1921 | 1200 |
| Example 2-0 | 27 | 73 | 0.53 | 0.44 | 1140 | 930 | 1435 | 1928 | 1200 |
| Example 2-24 | 26 | 72 | 0.52 | 0.44 | 1130 | 940 | 1408 | 1941 | 1200 |
| Example 2-24a | 18 | 61 | 0.52 | 0.43 | 1140 | 930 | 1391 | 1950 | 1100 |
| Example 2-25 | 19 | 65 | 0.53 | 0.44 | 1130 | 940 | 1382 | 1517 | 1100 |
| Example 2-26 | 22 | 71 | 0.52 | 0.45 | 1140 | 930 | 1438 | 1958 | 1200 |
| Example 2-0 | 27 | 73 | 0.53 | 0.44 | 1140 | 930 | 1435 | 1928 | 1200 |
| Example 2-27 | 27 | 69 | 0.51 | 0.43 | 1130 | 930 | 1421 | 1899 | 1200 |
| Example 2-28 | 15 | 57 | 0.51 | 0.43 | 1120 | 920 | 1391 | 1853 | 1100 |
| Comparative example 2-0 | 25 | 40 | 0.52 | 0.43 | 1130 | 930 | 1430 | 1905 | 800 |
| Comparative example 2-1 | 24 | 41 | 0.53 | 0.43 | 1150 | 930 | 1405 | 2033 | 800 |
| Comparative example 2-2 | 27 | 38 | 0.51 | 0.41 | 1100 | 940 | 1370 | 2151 | 800 |
| Comparative example 2-3 | 25 | 35 | 0.54 | 0.43 | 1140 | 930 | 1342 | 2251 | 800 |

According to Table 3 and Table 4, in case the R—O—C—N concentrated part had the core-shell structure and the covering ratio was 45% or more, excellent magnetic properties and corrosion resistance were obtained even when the composition of the R-T-B based permanent magnet was changed. Also, as Dy content increased, HcJ increased, but Br decreased and the corrosion resistance tended to decrease.

NUMERICAL REFERENCES

1 . . . R—O—C—N concentrated part
3 . . . R-T-B based permanent magnet
5 . . . Main phase grain
7 . . . Grain boundary
11 . . . Core part
13 . . . Shell part
21 . . . R—O—C—N concentrated part having core-shell structure
23 . . . R—O—C—N concentrated part not having core-shell structure
25 . . . Outer circumference part of R—O—C—N concentrated part
27 . . . High RH part

The invention claimed is:

1. An R-T-B based permanent magnet comprising main phase grains consisting of an $R_2T_{14}B$ crystal phase and grain boundaries formed between the main phase grains, wherein
R is a rare earth element, T is Fc or a combination of Fc and Co, and B is boron, wherein
the grain boundaries include an R—O—C—N concentrated part having higher concentrations of R, O, C, and N than in the main phase grains,
a ratio (N/R) of N atom with respect to R atom in the R—O—C—N concentrated part is 0.25 or more and 0.46 or less in average,
the R—O—C—N concentrated part includes a heavy rare earth element,
the R—O—C—N concentrated part comprises a core part and a shell part at least partially covering the core part,
a concentration of the heavy rare earth element in the shell part is higher than a concentration of the heavy rare earth element in the core part,
an average coverage of the shell part with respect to the core part in the R—O—C—N concentrated part is 45% or more and 77% or less.

2. The R-T-B based permanent magnet according to claim 1, wherein an area ratio of the R—O—C—N concentrated part is 16% or more and 71% or less in total with respect to the grain boundaries.

3. The R-T-B based permanent magnet according to claim 1, wherein a ratio (O/R) of O atom with respect to R atom in the R—O—C—N concentrated part is 0.44 or more and 0.75 or less in average.

4. The R-T-B based permanent magnet according to claim 2, wherein a ratio (O/R) of O atom with respect to R atom in the R—O—C—N concentrated part is 0.44 or more and 0.75 or less in average.

5. The R-T-B based permanent magnet according to claim 1, wherein an oxygen content in the R-T-B based permanent magnet is 920 ppm or more and 1990 ppm or less.

6. The R-T-B based permanent magnet according to claim 2, wherein an oxygen content in the R-T-B based permanent magnet is 920 ppm or more and 1990 ppm or less.

7. The R-T-B based permanent magnet according to claim 3, wherein an oxygen content in the R-T-B based permanent magnet is 920 ppm or more and 1990 ppm or less.

8. The R-T-B based permanent magnet according to claim 4, wherein an oxygen content in the R-T-B based permanent magnet is 920 ppm or more and 1990 ppm or less.

9. The R-T-B based permanent magnet according claim 1, wherein a carbon content in the R-T-B based permanent magnet is 890 ppm or more and 1150 ppm or less.

10. The R-T-B based permanent magnet according claim 2, wherein a carbon content in the R-T-B based permanent magnet is 890 ppm or more and 1150 ppm or less.

11. The R-T-B based permanent magnet according claim 3, wherein a carbon content in the R-T-B based permanent magnet is 890 ppm or more and 1150 ppm or less.

12. The R-T-B based permanent magnet according claim 4, wherein a carbon content in the R-T-B based permanent magnet is 890 ppm or more and 1150 ppm or less.

13. The R-T-B based permanent magnet according to claim 1, wherein a ratio (N/R) of N atom with respect to R atom in the R—O—C—N concentrated part is 0.29 or more and 0.45 or less in average.

14. The R-T-B based permanent magnet according to claim 2, wherein a ratio (N/R) of N atom with respect to R atom in the R—O—C—N concentrated part is 0.29 or more and 0.45 or less in average.

15. The R-T-B based permanent magnet according to claim 3, wherein a ratio (N/R) of N atom with respect to R atom in the R—O—C—N concentrated part is 0.29 or more and 0.45 or less in average.

16. The R-T-B based permanent magnet according to claim 4, wherein a ratio (N/R) of N atom with respect to R atom in the R—O—C—N concentrated part is 0.29 or more and 0.45 or less in average.

* * * * *